US008035610B2

(12) United States Patent
Hsu

(10) Patent No.: US 8,035,610 B2
(45) Date of Patent: Oct. 11, 2011

(54) LCD AND DISPLAY METHOD THEREOF

(75) Inventor: Chin-Hung Hsu, Taoyuan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 874 days.

(21) Appl. No.: 11/889,881

(22) Filed: Aug. 17, 2007

(65) Prior Publication Data

US 2008/0266232 A1 Oct. 30, 2008

(30) Foreign Application Priority Data

Apr. 25, 2007 (TW) ..... 96114695 A

(51) Int. Cl.
*G09G 3/36* (2006.01)

(52) U.S. Cl. ..... 345/103; 345/87

(58) Field of Classification Search ..... 345/87, 345/96, 97, 99, 101, 103
See application file for complete search history.

(56) References Cited

U.S. PATENT DOCUMENTS

| | | | | |
|---|---|---|---|---|
| 5,253,091 | A | 10/1993 | Kimura et al. | |
| 7,102,610 | B2 * | 9/2006 | Ludden | 345/96 |
| 7,286,107 | B2 * | 10/2007 | Lee et al. | 345/92 |
| 7,355,666 | B2 | 4/2008 | Song et al. | |
| 2008/0024408 | A1 | 1/2008 | Sano et al. | |

FOREIGN PATENT DOCUMENTS

| | | | |
|---|---|---|---|
| CN | 1866117 | * | 11/2006 |
| CN | 1866117 | A | 11/2006 |
| JP | 4067091 | A | 3/1992 |
| JP | 08-292417 | A | 11/1996 |
| JP | 2003-149676 | A | 5/2003 |
| JP | 2004-054295 | A | 2/2004 |
| JP | 2006-308628 | A | 11/2006 |
| JP | 2008-033312 | A | 2/2008 |
| WO | WO-2005/079167 | A2 | 9/2005 |
| WO | WO-2007/108150 | A1 | 9/2007 |

* cited by examiner

*Primary Examiner* — Quan-Zhen Wang
*Assistant Examiner* — Calvin Ma
(74) *Attorney, Agent, or Firm* — Rabin & Berdo, P.C.

(57) ABSTRACT

A LCD includes a first data line, a second data line and a third data line arranged sequentially, a first scan line, a second scan line and a third scan line arranged sequentially, and a pixel array. The pixel array includes a first pixel, a second pixel, a third pixel and a fourth pixel. The first pixel has a first transistor coupled to the first data line and the second scan line. The second pixel has a second transistor coupled to the second data line and the first scan line. The third pixel has a third transistor coupled to the second data line and the second scan line. The fourth pixel has a fourth transistor coupled to the third data line and the third scan line.

39 Claims, 5 Drawing Sheets

LCD AND DISPLAY METHOD THEREOF

This application claims the benefit of Taiwan application Ser. No. 96114695, filed Apr. 25, 2007, the subject matter of which is incorporated herein by reference.

BACKGROUND OF THE INVENTION

1. Field of the Invention

The invention relates in general to a liquid crystal display (LCD) and a display method thereof, and more particularly to a LCD having a power-saving effect and a better display effect, and a display method thereof.

2. Description of the Related Art

FIG. 1 (Prior Art) is a schematic illustration showing a conventional LCD 100. Referring to FIG. 1, the LCD 100 includes multiple data lines DL1 to DL6, multiple scan lines S1 to S5, a pixel array 105, a timing controller 110, a data driver 120 and a scan driver 130. The timing controller 110 outputs a data driving signal DDS to the data driver 120, and outputs a scan driving signal SDS to the scan driver 130. The data driving signal DDS substantially includes data (DATA) to be represented on multiple pixels, and some control signals for data driver. A polarity signal (POL) among these control signals decides the polarity of a liquid crystal.

The pixel array 105 includes a plurality of pixels each corresponding to a data line and a scan line. Taking a pixel 141 an example, the pixel 141 corresponds to the data line DL6 and the scan line S5. The pixel 141 includes a transistor M having an input terminal coupled to the data line DL6, an output terminal coupled to a pixel electrode (not shown), and a control terminal coupled to the scan line S5.

The pixel cannot be always kept on a certain voltage, or otherwise the liquid crystal molecules in the pixel cannot be rotated to form different gray-scale levels in response to the variation of the electric field due to the damage to the property thereof. So, the polarity signal in the data driving signal DDS has to be inverted every period of time. The continuous exchange between the positive and negative polarities can prevent the property of each liquid crystal molecule in the pixel from being polarized.

Conventionally, many polarity inversion methods may be adopted to the pixel of the LCD 100 to prevent the liquid crystal molecule from being polarized, and the methods include a column inversion method, a dot inversion method and a (1+2) line inversion method. In the column inversion method, the pixels in the same column have the same polarity. In the LCD 100, for example, the pixels A1 to A5, the pixels C1 to C5 and the pixels E1 to E5 have the positive polarities, while the pixels B1 to B5, the pixels D1 to D5 and the pixels F1 to F5 have the negative polarities. However, the pixels in each column have different polarities, which tend to cause the phenomena of flicker and crosstalk to be generated in the LCD 100.

In the dot inversion method for polarity inversion, the polarity of the pixel is different from the polarities of top, bottom, left and right pixels adjacent to the pixel. In the LCD 100, for example, when the pixel B4 has the positive polarity, the pixels B5, B3, A4 and C4 have the negative polarities. The (1+2) line inversion method is substantially one of the dot inversion methods. In the LCD 100, for example, when the pixels B2 and B3 have the positive polarities, the pixels B4, B5, B1, A2, A3, C2 and C3 have the negative polarities. The dot inversion method and the (1+2) line inversion method for polarity inversion have to pay for the extremely high power consumption so that the LCD can obtain the better display effect due to the alternate polarities of the pixels. Consequently, the power consumption is negatively influenced under the trend in the application with the larger scale and the higher resolution.

SUMMARY OF THE INVENTION

The invention is directed to a LCD and a display method thereof, in which data lines of the LCD are driven in a column inversion manner for polarity inversion so that a pixel array represents a display effect in a dot inversion for polarity inversion.

According to a first aspect of the present invention, a liquid crystal display (LCD) is provided. The LCD includes a first data line, a second data line and a third data line which are arranged sequentially, a first scan line, a second scan line and a third scan line which are arranged sequentially, and a pixel array. The pixel array includes a first pixel, a second pixel, a third pixel and a fourth pixel. The first pixel is located at coordinates (1,1) of the pixel array and has a first transistor coupled to the first data line and the second scan line. The second pixel is located at coordinates (2,1) of the pixel array and has a second transistor coupled to the second data line and the first scan line. The third pixel is located at coordinates (1,2) of the pixel array and has a third transistor coupled to the second data line and the second scan line. The fourth pixel is located at coordinates (2,2) of the pixel array and has a fourth transistor coupled to the third data line and the third scan line.

According to a second aspect of the present invention, a display method for a liquid crystal display (LCD) is provided. The LCD includes a first data line, a second data line and a third data line which are arranged sequentially, a first scan line, a second scan line and a third scan line which are arranged sequentially, and a pixel array, which comprises a first pixel, a second pixel, a third pixel and a fourth pixel. The first pixel is located at coordinates (1,1) of the pixel array and has a first transistor coupled to the first data line and the second scan line. The second pixel is located at coordinates (2,1) of the pixel array and has a second transistor coupled to the second data line and the first scan line. The third pixel is located at coordinates (1,2) of the pixel array and has a third transistor coupled to the second data line and the second scan line. The fourth pixel is located at coordinates (2,2) of the pixel array and has a fourth transistor coupled to the third data line and the third scan line. The method includes the steps of: rearranging a first piece of pixel data into a second piece of pixel data; and driving the pixel array in a column inversion manner to make the pixel array display an image in a dot inversion manner.

According to a third aspect of the present invention, a liquid crystal display (LCD) is provided. The LCD includes a first data line, a second data line and a third data line which are arranged sequentially, a first scan line, a second scan line, a third scan line and a fourth scan line which are arranged sequentially, and a pixel array. The pixel array includes a first pixel, a second pixel, a third pixel, a fourth pixel, a fifth pixel and a sixth pixel. The first pixel is located at coordinates (1,1) of the pixel array and has a first transistor coupled to the first data line and the second scan line. The second pixel is located at coordinates (2,1) of the pixel array and has a second transistor coupled to the second data line and the first scan line. The third pixel is located at coordinates (1,2) of the pixel array and has a third transistor coupled to the second data line and the second scan line. The fourth pixel is located at coordinates (2,2) of the pixel array and has a fourth transistor coupled to the third data line and the third scan line. The fifth pixel is located at coordinates (1,3) of the pixel array and has a fifth transistor coupled to the second data line and the third scan line. The sixth pixel is located at coordinates (2,3) of the pixel array and has a sixth transistor coupled to the third data line and the fourth scan line.

According to a fourth aspect of the present invention, a display method for a liquid crystal display (LCD) is provided. The LCD includes a first data line, a second data line and a third data line which are arranged sequentially, a first scan line, a second scan line, a third scan line and a fourth scan line which are arranged sequentially, and a pixel array, which includes a first pixel, a second pixel, a third pixel, a fourth pixel, a fifth pixel and a sixth pixel. The first pixel is located at coordinates (1,1) of the pixel array and has a first transistor coupled to the first data line and the second scan line. The second pixel is located at coordinates (2,1) of the pixel array and has a second transistor coupled to the second data line and the first scan line. The third pixel is located at coordinates (1,2) of the pixel array and has a third transistor coupled to the second data line and the second scan line. The fourth pixel is located at coordinates (2,2) of the pixel array and has a fourth transistor coupled to the third data line and the third scan line. The fifth pixel is located at coordinates (1,3) of the pixel array and has a fifth transistor coupled to the second data line and the third scan line. The sixth pixel is located at coordinates (2,3) of the pixel array and has a sixth transistor coupled to the third data line and the fourth scan line. The method includes the steps of: rearranging a first piece of pixel data into a second piece of pixel data; and driving the pixel array in a column inversion manner to make the pixel array display an image in a (1+2) line inversion manner.

According to a fifth aspect of the present invention, a liquid crystal display (LCD) is provided. The LCD includes a plurality of data lines, a plurality of scan lines, a pixel array and a data converter. The pixel array includes a plurality of pixels each corresponding to one of the data lines and one of the scan lines. Neighboring two pixels located in the same row are controlled by different scan lines. The data converter rearranges a first piece of pixel data into a second piece of pixel data. The pixel array is driven in a column inversion manner so that the pixel array displays an image in a dot inversion or (1+2) line inversion manner.

The invention will become apparent from the following detailed description of the preferred but non-limiting embodiments. The following description is made with reference to the accompanying drawings.

DETAILED DESCRIPTION OF THE INVENTION

The invention relates to a liquid crystal display (LCD) and a display method thereof, in which a pixel array of the LCD represents a frame in a dot inversion manner for polarity inversion by driving the pixel array in a column inversion manner for polarity inversion so that the LCD has the power-saving effect and the better display effect.

Figure 1:
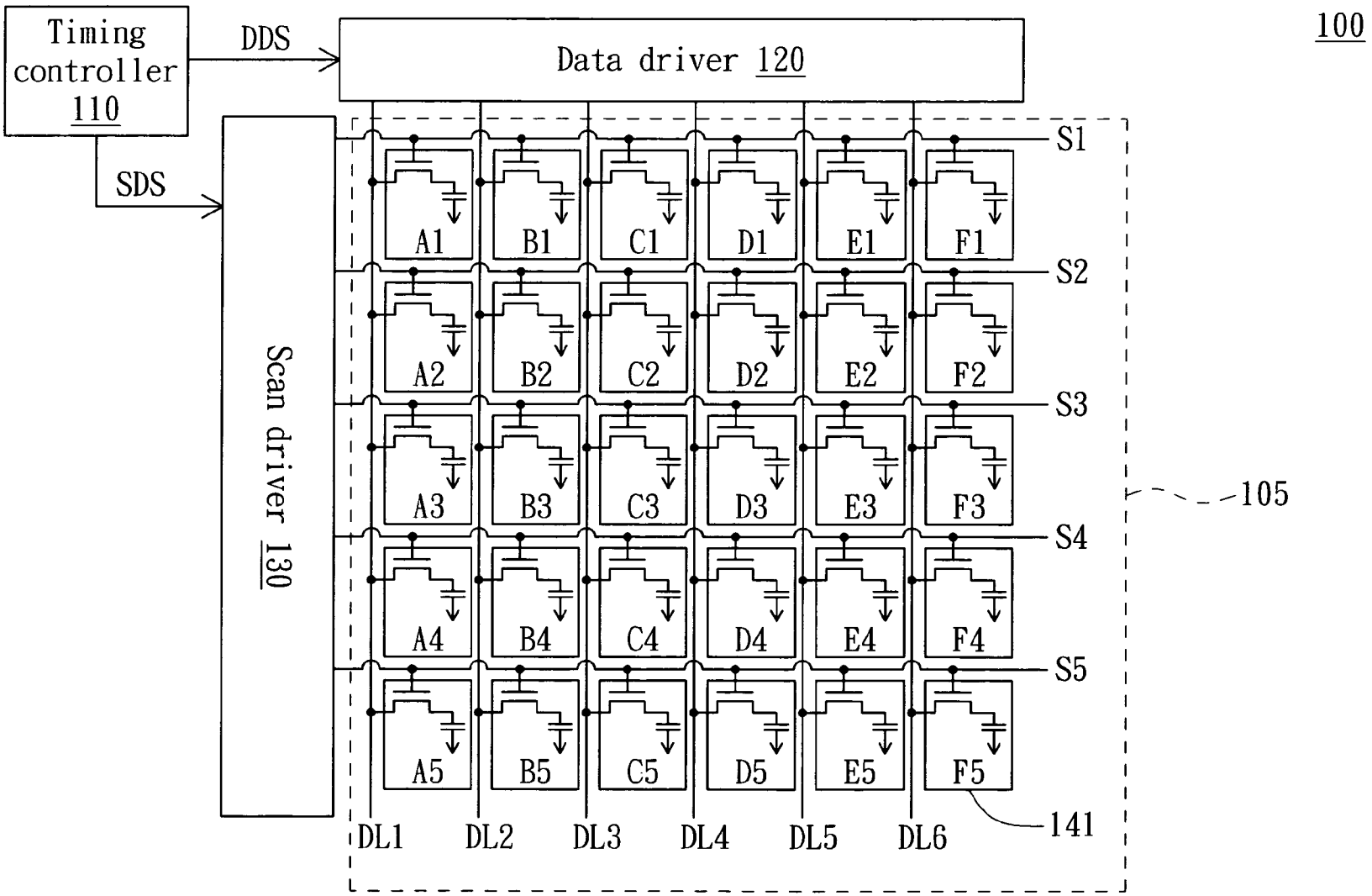
FIG. 1(PRIOR ART)
FIG. 1 (Prior Art) is a schematic illustration showing a conventional LCD.
Figure 2A:
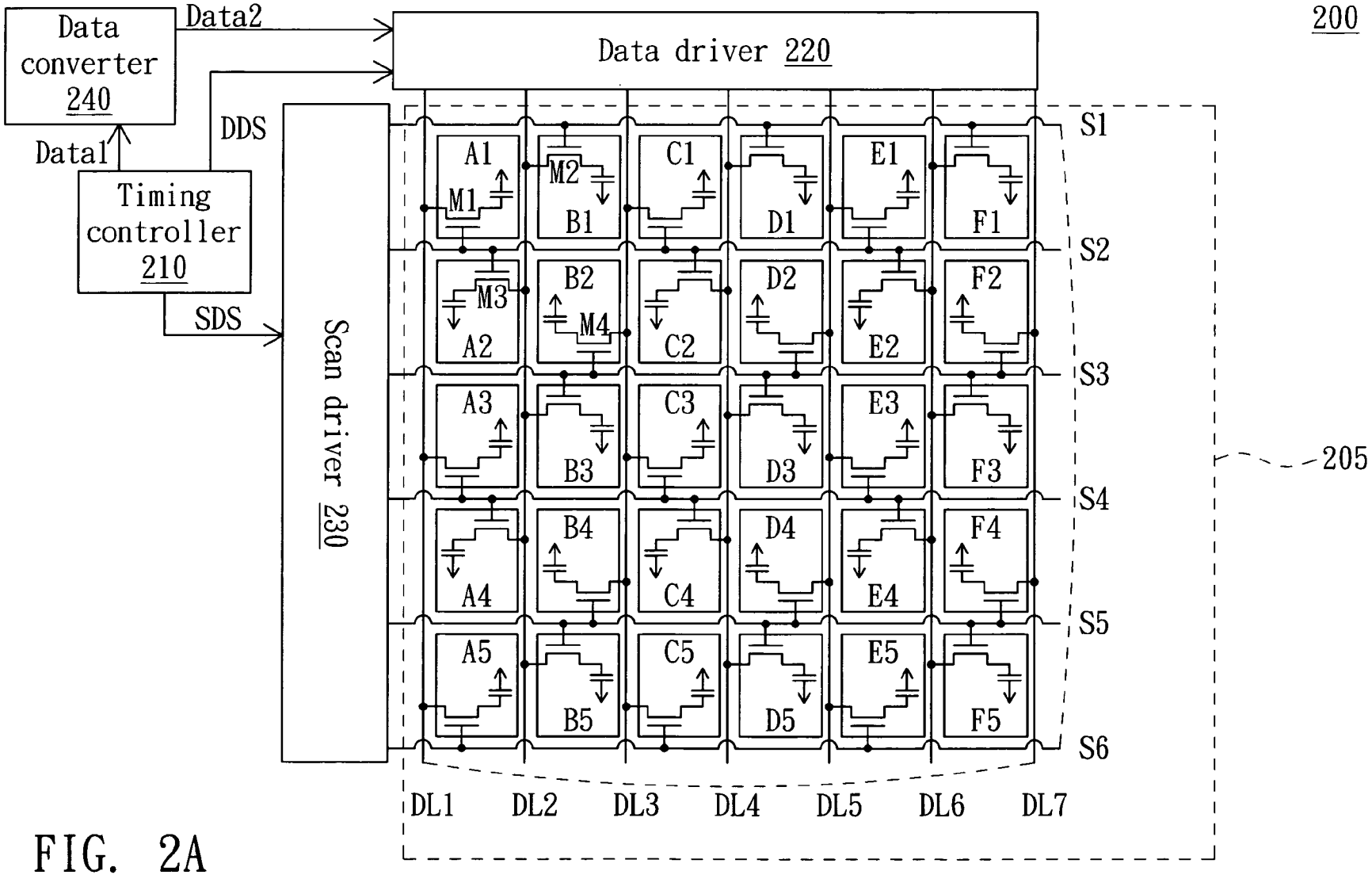
FIG. 2A is a schematic illustration showing a LCD according to a first embodiment of the invention.

FIG. 2A is a schematic illustration showing a LCD 200 according to a first embodiment of the invention. Referring to FIG. 2A, the LCD 200 includes multiple data lines DL1 to DL7, multiple scan lines S1 to S6, a pixel array 205, a timing controller 210, a data driver 220, a scan driver 230 and a data converter 240. The scan lines S1 to S6 are coupled to the scan driver 230, and the data lines DL1 to DL7 are coupled to the data driver 220.

The pixel array 205 includes a plurality of pixels each corresponding to one of the data lines DL1 to DL7 and one of the scan lines S1 to S6. The pixels A1, A2, B1 and B2 will be described in the following example. The pixel A1 has a first transistor M1 and a first pixel electrode (not shown). The first transistor M1 has an input terminal coupled to the data line DL1, an output terminal coupled to the first pixel electrode, and a control terminal coupled to the scan line S2. The pixel B1 has a second transistor M2 and a second pixel electrode (not shown). The second transistor M2 has an input terminal coupled to the data line DL2, an output terminal coupled to the second pixel electrode and a control terminal coupled to the scan line S1.

The pixel A2 has a third transistor M3 and a third pixel electrode (not shown). The third transistor M3 has an input terminal coupled to the data line DL2, an output terminal coupled to the third pixel electrode, and a control terminal coupled to the scan line S2. The pixel B2 has a fourth transistor M4 and a fourth pixel electrode (not shown). The fourth transistor M4 has an input terminal coupled to the data line DL3, an output terminal coupled to the fourth pixel electrode, and a control terminal coupled to the scan line S3.

In the pixel array 205, neighboring two pixels located in the same row are respectively controlled by different scan lines. For example, the pixel B2 located in the second row is controlled by the scan line S3, and its neighboring pixel C2 is controlled by the scan line S2. In addition, the two scan lines S1 and S6 located on two side edges of the pixel array may be electrically connected to each other through the printed circuit board layout or the glass layout, while the two data lines DL1 and DL7 located on two side edges of the pixel array may also be electrically connected to each other through the printed circuit board layout or the glass layout. The connected scan lines S1 and S6 and the connected data lines DL1 and DL7 can simplify the pixel data that has to be generated by the timing controller 210. Otherwise, compared with the conventional LCD, the extra output channel for both data driver and scan driver are needed.

The timing controller 210 generates a first piece of pixel data Data1 and outputs a scan driving signal SDS to the scan driver 230, and outputs a data driver signal DDS to the data driver 220. The timing controller 210 controls the data driver 220 to drive the pixel array 205 of the LCD 200 in a column inversion manner for polarity inversion. The data converter 240 rearranges the first piece of pixel data Data1 into a second piece of pixel data Data2 according to the structure of the pixel array 205. The pixel array 205 displays an image in a dot inversion manner for polarity inversion.

The data converter 240 may be substantially a line buffer for buffering and accumulating the first piece of pixel data Data1 to a predetermined level and then rearranging the first piece of pixel data Data1 into the second piece of pixel data Data2. The data converter 240 may be integrated in the timing controller 210 or the data driver 220 to save the area, and may also be individually disposed in the LCD 200.

Figure 2B:
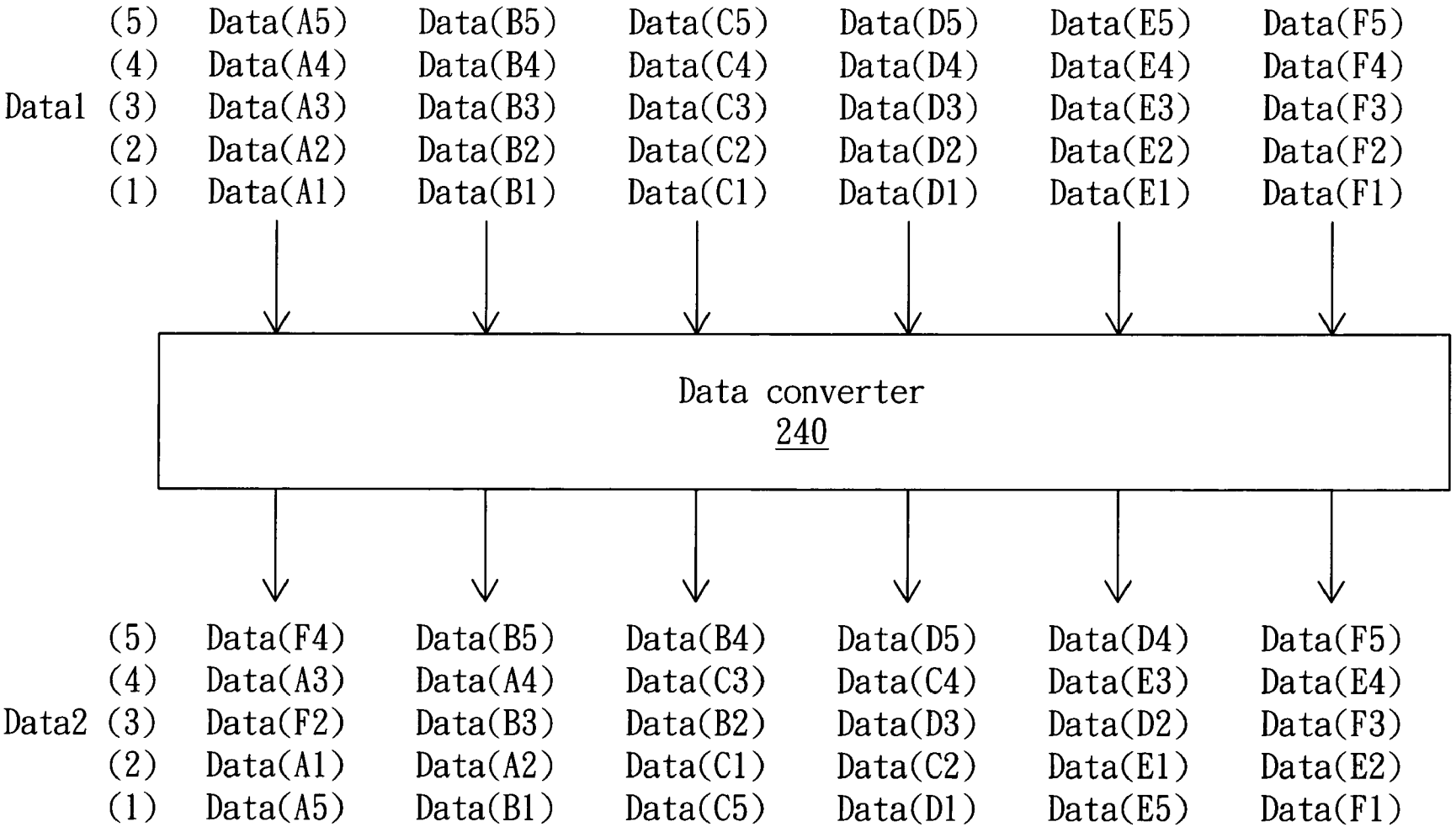
FIG. 2B is a schematic illustration showing an example of pixel data conversion according to the first embodiment of the invention.

FIG. 2B is a schematic illustration showing an example of pixel data conversion according to the first embodiment of the invention. As showing in FIG. 2B, the scan lines S1 and S6 are electrically connected to each other, and the data lines DL1 and DL7 are electrically connected to each other. The first piece of pixel data Data1 is rearranged into the second piece of pixel data Data2 through the data converter 240, and the timing controller 210 drives the pixel array 205 in the column inversion manner for polarity inversion. The first piece of pixel data Data1 and the second piece of pixel data Data2 are the pixel data in the same frame. However, because the scan lines S1 and S6 are electrically connected to each other and the data lines DL1 and DL7 are electrically connected to each other, the pixel data corresponding to the pixels A5, C5 and E5 in the second piece of pixel data Data2 should be the pixel data of a previous frame in order to keep the completeness of displaying the image.

Consequently, the pixel array 205 of the LCD 200 displays the image in the dot inversion manner for polarity inversion according to the pixel structure of the LCD 200 and the rearranged second piece of pixel data Data2.

In the LCD 200 of this embodiment, the pixel array 205 in the LCD 200 is driven in the column inversion manner for polarity inversion so that the pixel array 205 displays the image in the dot inversion manner for polarity inversion. Consequently, the object of driving can be achieved with the lower power consumption and the better frame display effect.

Figure 3A:
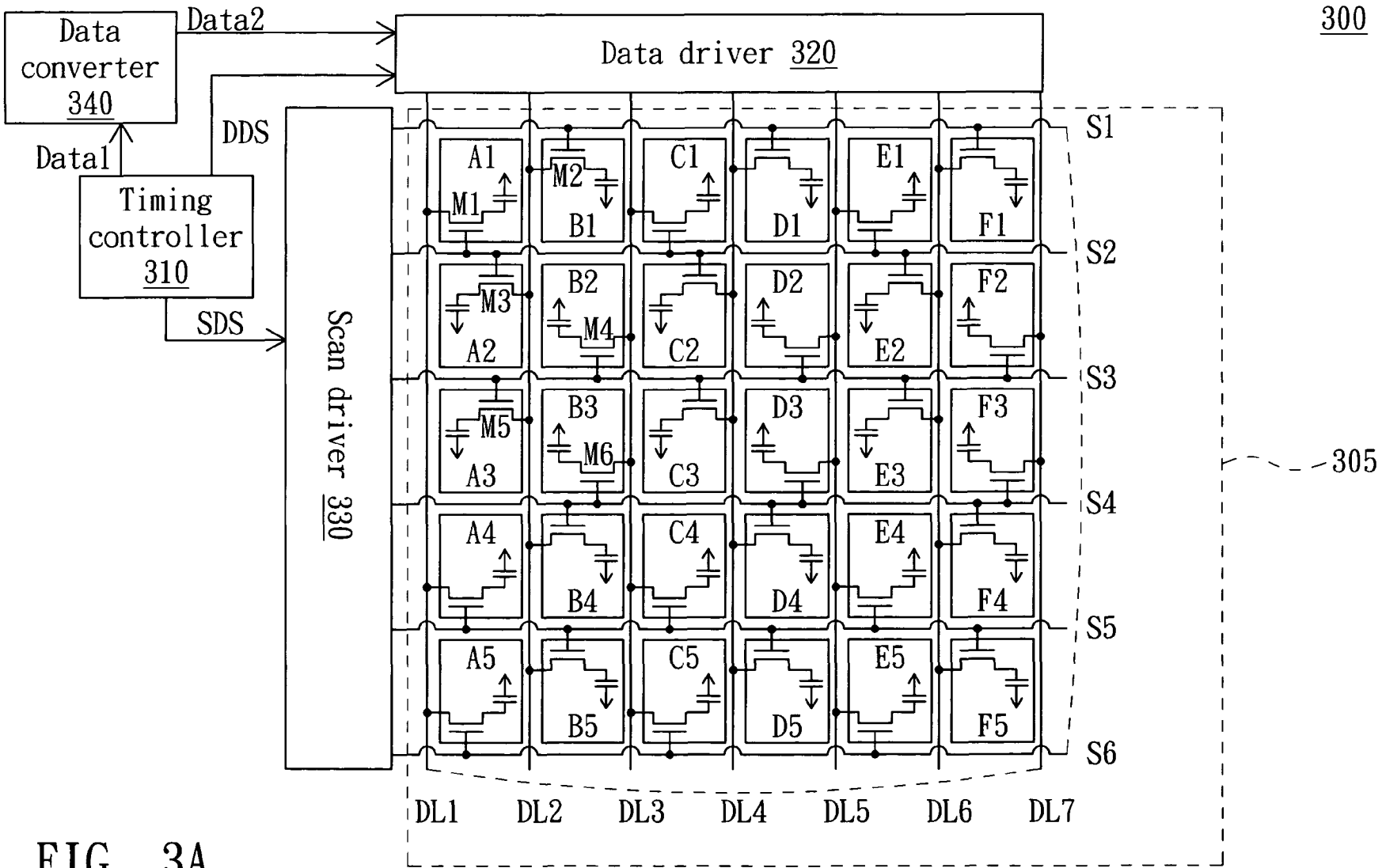
FIG. 3A is a schematic illustration showing a LCD according to a second embodiment of the invention.

FIG. 3A is a schematic illustration showing a LCD 300 according to a second embodiment of the invention. Referring to FIG. 3A, the LCD 300 includes multiple data lines DL1 to DL7, multiple scan lines S1 to S6, a pixel array 305, a timing controller 310, a data driver 320, a scan driver 330 and a data converter 340. The scan lines S1 to S6 are coupled to the scan driver 330 and the data lines DL1 to DL7 are coupled to the data driver 320.

The pixel array 305 includes multiple pixels each corresponding to one of the data lines DL1 to DL7 and one of the scan lines S1 to S6. Illustrations will be made by taking the pixels A1 to A3 and the pixels B1 to B3 as an example. The pixel A1 has a first transistor M1 and a first pixel electrode (not shown). The first transistor M1 has an input terminal coupled to the data line DL1, an output terminal coupled to the first pixel electrode, and a control terminal coupled to the scan line S2. The pixel B1 has a second transistor M2 and a second pixel electrode (not shown). The second transistor M2 has an input terminal coupled to the data line DL2, an output terminal coupled to the second pixel electrode, and a control terminal coupled to the scan line S1.

The pixel A2 has a third transistor M3 and a third pixel electrode (not shown). The third transistor M3 has an input terminal coupled to the data line DL2, an output terminal coupled to the third pixel electrode, and a control terminal coupled to the scan line S2. The pixel B2 has a fourth transistor M4 and a fourth pixel electrode (not shown). The fourth transistor M4 has an input terminal coupled to the data line DL3, an output terminal coupled to the fourth pixel electrode and a control terminal coupled to the scan line S3.

The pixel A3 has a fifth transistor M6 and a fifth pixel electrode (not shown). The fifth transistor M5 has an input terminal coupled to the data line DL2, an output terminal coupled to the fifth pixel electrode and a control terminal coupled to the scan line S3. The pixel B3 has a sixth transistor M6 and a sixth pixel electrode (not shown). The sixth transistor M6 has an input terminal coupled to the data line DL3, an output terminal coupled to the sixth pixel electrode and a control terminal coupled to the scan line S4.

In the pixel array 305, neighboring two pixels located in the same row are respectively controlled by different scan lines. For example, the pixel B3 located in the third row is controlled by the scan line S4, and the pixel C3 adjacent to the pixel B3 is controlled by the scan line S3. In addition, the two scan lines S1 and S6 located on two side edges of the pixel array may be electrically connected to each other through the printed circuit board layout or the glass layout, while the two data lines DL1 and DL7 located at two side edges of the pixel array may also be electrically connected to each other through the printed circuit board layout or the glass layout. The connected scan lines S1 and S6 and the connected data lines DL1 and DL7 may simplify the data that has to be generated by the timing controller 210. Otherwise, compared with the conventional LCD, the extra output channel for both data driver and scan driver are needed.

The timing controller 310 generates a first piece of pixel data Data1, outputs a scan driving signal SDS to the scan driver 330 and outputs a data driver signal DDS to the data driver 320. The timing controller 310 controls the data driver 320 to drive the pixel array 305 of the LCD 300 in the column inversion manner for polarity inversion. The data converter 340 rearranges the first piece of pixel data Data1 into a second piece of pixel data Data2 according to the structure of the pixel array 305. The pixel array 305 displays the frame in the (1+2) line inversion manner for polarity inversion.

The data converter 340 may be substantially a line buffer for buffering and accumulating the first piece of pixel data Data1 to a predetermined level so that the first piece of pixel data Data1 may be rearranged into the second piece of pixel data Data2. The data converter 340 may be integrated in the timing controller 310 or the data driver 320 to save the area, or may also be individually disposed in the LCD 300.

Figure 3B:
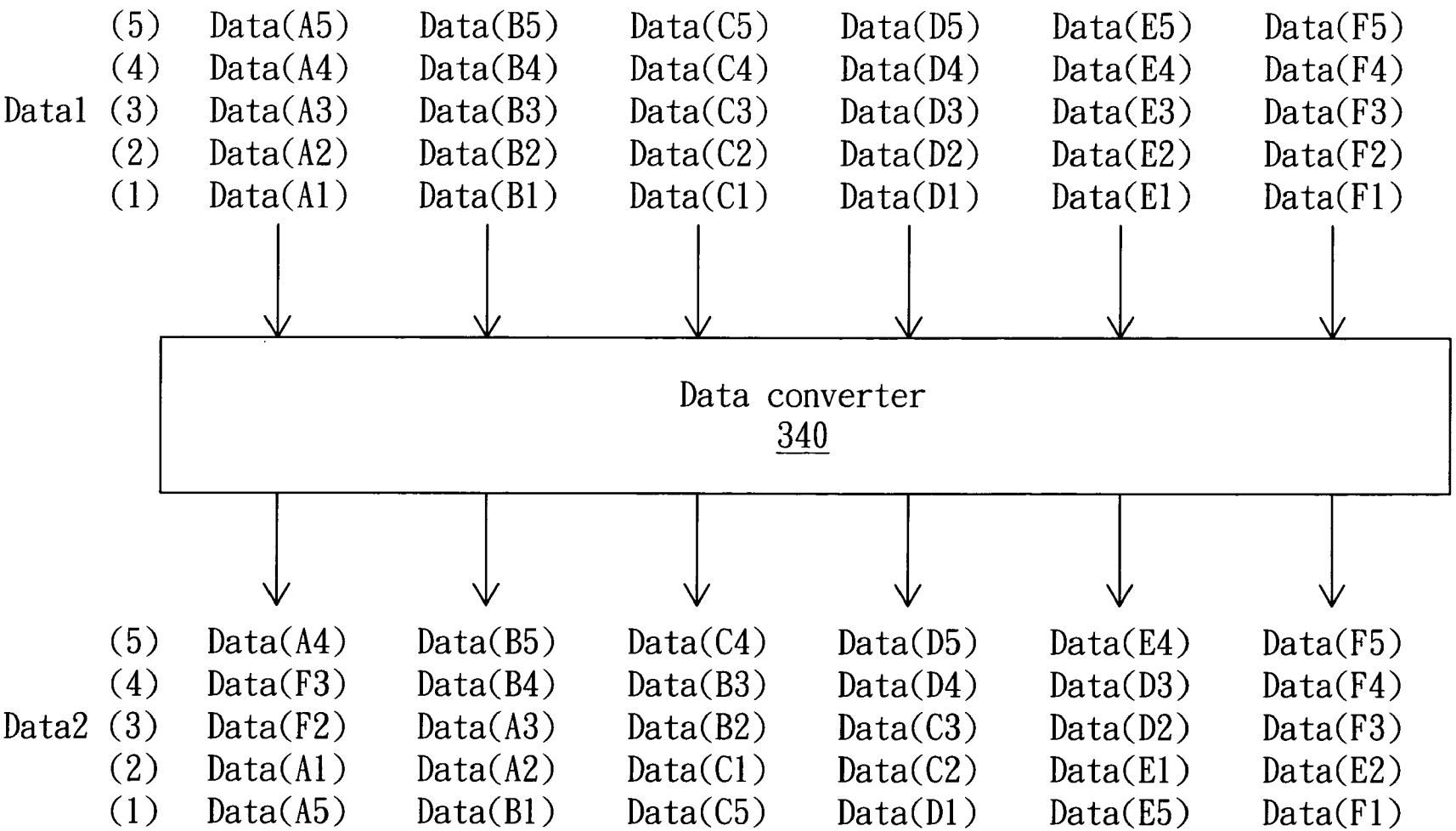
FIG. 3B is a schematic illustration showing an example of pixel data conversion according to the second embodiment of the invention.

FIG. 3B is a schematic illustration showing an example of pixel data conversion according to the second embodiment of the invention. At this time, as shown in FIG. 3B, the scan lines S1 and S6 are electrically connected to each other, and the data lines DL1 and DL7 are electrically connected to each other. The first piece of pixel data Data1 is converted into the second piece of pixel data Data2 through the data converter 340 while the timing controller 310 drives the pixel array 305 in the column inversion manner for polarity inversion. The first piece of pixel data Data1 and the second piece of pixel data Data2 may be the pixel data in the same frame. However, because the scan lines S1 and S6 are electrically connected to each other and the data lines DL1 and DL7 are electrically connected to each other, the pixel data corresponding to the pixels A5, C5 and E5 in the second piece of pixel data Data2 should be the pixel data in a previous frame in order to keep the completeness of displaying the image.

Consequently, the pixel array 305 of the LCD 300 displays the image in the (1+2) line inversion manner for polarity inversion according to the pixel structure of the LCD 300 and the rearranged second piece of pixel data Data2.

In the LCD 300 of this embodiment, the pixel array 305 in the LCD 300 is driven in the column inversion manner for polarity inversion so that the pixel array 305 displays the image in the (1+2) line inversion manner for polarity inversion. Consequently, the object of driving can be achieved with the lower power consumption and the better frame display effect.

In the LCDs and display methods thereof according to the embodiments of the invention, the timing controller controls the data driver to drive the pixel array of the LCD in the column inversion manner for polarity inversion so that the power consumption can be reduced and the power may be saved. Then, the data is rearranged according to the pixel structure of the LCD so that the pixel array in the LCD can display the image in the dot inversion or (1+2) line inversion manner for polarity inversion and the LCD can possess the better frame display effect.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display (LCD), comprising:

a first data line, a second data line and a third data line arranged sequentially;

a first scan line, a second scan line and a third scan line arranged sequentially, wherein a first column is defined between the first data line and the second data line, a second column is defined between the second data line and the third data line, a first row is defined between the first scan line and the second scan line, a second row is defined between the second scan line and the third scan line; and a pixel array, which comprises:

a first pixel, which is located at the first row and the first column of the pixel array and has a first transistor coupled to the first data line and the second scan line;

a second pixel, which is located at the first row and the second column of the pixel array and has a second transistor coupled to the second data line and the first scan line;

a third pixel, which is located at the second row and the first column of the pixel array, and has a third transistor coupled to the second data line and the second scan line; and a fourth pixel located at the second row and the second column of the pixel array and has a fourth transistor coupled to the third data line and the third scan line.

2. The LCD according to claim 1, wherein the pixel array is driven in a column inversion manner.

3. The LCD according to claim 2, wherein the pixel array displays an image in a dot inversion manner.

4. The LCD according to claim 1, further comprising:

a data converter for rearranging a first piece of pixel data into a second piece of pixel data, and outputting the second piece of pixel data to the pixel array through the data lines.

5. The LCD according to claim 4, wherein the data converter rearranges the first piece of pixel data into the second piece of pixel data according to the pixel array.

6. The LCD according to claim 4, wherein the data converter comprises a line buffer.

7. The LCD according to claim 4, further comprising:

a scan driver coupled to the scan lines;

a data driver coupled to the data lines; and a timing controller for outputting a scan driving signal to the scan driver and outputting a data driving signal to the data driver.

8. The LCD according to claim 7, wherein the timing controller generates the first piece of pixel data, and the data driver outputs the second piece of pixel data to the pixel array through the data lines.

9. The LCD according to claim 7, wherein the data converter is disposed in the timing controller.

10. The LCD according to claim 7, wherein the data converter is disposed in the data driver.

11. The LCD according to claim 1, wherein the first data line is electrically connected to the last data line.

12. The LCD according to claim 1, wherein the first scan line is electrically connected to the last scan line.

13. A display method for a liquid crystal display (LCD), the method comprising the steps of:

providing a LCD comprising a first data line, a second data line and a third data line which are arranged sequentially, a first scan line, a second scan line and a third scan line which are arranged sequentially, wherein a first column is defined between the first data line and the second data line, a second column is defined between the second data line and the third data line, a first row is defined between the first scan line and the second scan line, a second row is defined between the second scan line and the third scan line, and a pixel array, which comprises a first pixel, a second pixel, a third pixel and a fourth pixel, wherein the first pixel is located at the first row and the first column of the pixel array and has a first transistor coupled to the first data line and the second scan line, the second pixel is located at the first row and the second column of the pixel array and has a second transistor coupled to the second data line and the first scan line, the third pixel is located at the second row and the first column of the pixel array and has a third transistor coupled to the second data line and the second scan line, the fourth pixel is located at the second row and the second column of the pixel array and has a fourth transistor coupled to the third data line and the third scan line;

rearranging a first piece of pixel data into a second piece of pixel data; and driving the pixel array in a column inversion manner to make the pixel array display an image in a dot inversion manner according to structure of the pixel array of the LCD and the second piece of pixel data.

14. The method according to claim 13, wherein a data converter rearranges the first piece of pixel data into the second piece of pixel data according to the pixel array.

15. A liquid crystal display (LCD), comprising:

a first data line, a second data line and a third data line arranged sequentially;

a first scan line, a second scan line, a third scan line and a fourth scan line arranged sequentially, wherein a first column is defined between the first data line and the second data line, a second column is defined between the second data line and the third data line, a first row is defined between the first scan line and the second scan line, a second row is defined between the second scan line and the third scan line, a third row is defined between the third scan line and the fourth scan line; and a pixel array, which comprises:

a first pixel, which is located at the first row and the first column of the pixel array and has a first transistor coupled to the first data line and the second scan line;

a second pixel, which is located at the first row and the second column of the pixel array and has a second transistor coupled to the second data line and the first scan line;

a third pixel, which is located at the second row and the first column of the pixel array and has a third transistor coupled to the second data line and the second scan line;

a fourth pixel, which is located at the second row and the second column of the pixel array and has a fourth transistor coupled to the third data line and the third scan line;

a fifth pixel, which is located at the third row and the first column of the pixel array and has a fifth transistor coupled to the second data line and the third scan line; and a sixth pixel, which is located at the third row and the second column of the pixel array and has a sixth transistor coupled to the third data line and the fourth scan line.

16. The LCD according to claim 15, wherein the pixel array is driven in a column inversion manner.

17. The LCD according to claim 16, wherein the pixel array displays an image in a (1+2) line inversion manner.

18. The LCD according to claim 15, further comprising:

a data converter for rearranging a first piece of pixel data into a second piece of pixel data and outputting the second piece of pixel data to the pixel array through the data lines.

19. The LCD according to claim 18, wherein the data converter rearranges the first piece of pixel data into the second piece of pixel data according to the pixel array.

20. The LCD according to claim 18, wherein the data converter comprises a line buffer.

21. The LCD according to claim 18, further comprising:

a scan driver coupled to the scan lines;

a data driver coupled to the data lines; and a timing controller for outputting a scan driving signal to the scan driver and outputting a data driving signal to the data driver.

22. The LCD according to claim 21, wherein the timing controller generates the first piece of pixel data, and the data driver outputs the second piece of pixel data to the pixel array through the data lines.

23. The LCD according to claim 21, wherein the data converter is disposed in the timing controller.

24. The LCD according to claim 21, wherein the data converter is disposed in the data driver.

25. The LCD according to claim 15, wherein the first data line is electrically connected to the last data line.

26. The LCD according to claim 15, wherein the first scan line is electrically connected to the last scan line.

27. A display method for a liquid crystal display (LCD), the method comprising the steps of:

providing a LCD comprising a first data line, a second data line and a third data line which are arranged sequentially, a first scan line, a second scan line, a third scan line and a fourth scan line which are arranged sequentially, wherein a first column is defined between the first data line and the second data line, a second column is defined between the second data line and the third data line, a first row is defined between the first scan line and the second scan line, a second row is defined between the second scan line and the third scan line, a third row is defined between the third scan line and the fourth scan line, and a pixel array, which includes a first pixel, a second pixel, a third pixel, a fourth pixel, a fifth pixel and a sixth pixel, wherein the first pixel is located at the first row and the first column of the pixel array and has a first transistor coupled to the first data line and the second scan line, the second pixel is located at the first row and the second column of the pixel array and has a second transistor coupled to the second data line and the first scan line, the third pixel is located at the second row and the first column of the pixel array and has a third transistor coupled to the second data line and the second scan line, the fourth pixel is located at the second row and the second column of the pixel array and has a fourth transistor coupled to the third data line and the third scan line, the fifth pixel is located at the third row and the first column of the pixel array and has a fifth transistor coupled to the second data line and the third scan line, the sixth pixel is located at the third row and the second column of the pixel array and has a sixth transistor coupled to the third data line and the fourth scan line;

rearranging a first piece of pixel data into a second piece of pixel data; and driving the pixel array in a column inversion manner to make the pixel array display an image in a (1+2) line inversion manner according to structure of the pixel array of the LCD and the second piece of pixel data.

28. The method according to claim 27, wherein a data converter rearranges the first piece of pixel data into the second piece of pixel data according to the pixel array.

29. A liquid crystal display (LCD), comprising:

a plurality of data lines;

a plurality of scan lines;

a pixel array comprising a plurality of pixels each corresponding to one of the data lines and one of the scan lines, wherein neighboring two pixels located in the same row are controlled only by different scan lines and different data lines; and a data converter for rearranging a first piece of pixel data into a second piece of pixel data, wherein the first piece of pixel data including a plurality of groups of input pixel data for the respective data lines and the second piece of pixel data including a plurality of groups of output pixel data for the respective data lines, the data converter rearranges a first one of the groups of input pixel data for a first one of the data lines with a second one of the groups of input pixel data for a second one of the data lines adjacent to the first one of the data lines into a corresponding one of the groups of output pixel data for the first one of the data lines, wherein the data converter replaces a portion of data of the first one of the groups of input pixel data with a corresponding portion of data of the second one of the groups of input pixel data so as to output the corresponding one of the groups of output pixel data, wherein the pixel array is driven in a first inversion manner so that the pixel array displays an image in a second inversion manner, and the first and second inversion manners are different.

30. The LCD according to claim 29, wherein the first inversion manner is a column inversion manner.

31. The LCD according to claim 29, wherein the second inversion manner is a dot inversion manner or a (1+2) line inversion manner.

32. The LCD according to claim 29, wherein the data converter rearranges the first piece of pixel data into the second piece of pixel data according to the pixel array.

33. The LCD according to claim 29, wherein the data converter comprises a line buffer.

34. The LCD according to claim 29, further comprising:

a scan driver coupled to the scan lines;

a data driver coupled to the data lines; and a timing controller for outputting a scan driving signal to the scan driver and outputting a data driving signal to the data driver.

35. The LCD according to claim 34, wherein the timing controller generates the first piece of pixel data, and the data driver outputs the second piece of pixel data to the pixel array through the data lines.

36. The LCD according to claim 34, wherein the data converter is disposed in the timing controller.

37. The LCD according to claim 34, wherein the data converter is disposed in the data driver.

38. The LCD according to claim 29, wherein two of the data lines located on two side edges of the pixel array are electrically connected to each other.

39. The LCD according to claim 29, wherein two of the scan lines located on two side edges of the pixel array are electrically connected to each other.

* * * * *